US008047552B2

(12) United States Patent
Julien

(10) Patent No.: US 8,047,552 B2
(45) Date of Patent: Nov. 1, 2011

(54) NITINOL ICE BLADES

(75) Inventor: Gerald J. Julien, Puyallup, WA (US)

(73) Assignee: Nitinol Technology, Inc., Edgewood, WA (US)

( * ) Notice: Subject to any disclaimer, the term of this patent is extended or adjusted under 35 U.S.C. 154(b) by 1080 days.

(21) Appl. No.: 10/505,356

(22) PCT Filed: Feb. 20, 2003

(86) PCT No.: PCT/US03/05518

§ 371 (c)(1),
(2), (4) Date: Aug. 19, 2004

(87) PCT Pub. No.: WO03/072206

PCT Pub. Date: Sep. 4, 2003

(65) Prior Publication Data

US 2005/0082773 A1 Apr. 21, 2005

Related U.S. Application Data

(60) Provisional application No. 60/358,988, filed on Feb. 21, 2002.

(51) Int. Cl.
*A63C 1/42* (2006.01)

(52) U.S. Cl. ..... 280/11.18

(58) Field of Classification Search ..... 280/841, 280/11.12, 11.18

See application file for complete search history.

(56) References Cited

U.S. PATENT DOCUMENTS 3,174,851 A * 3/1965 Buchler et. al. ..... 148/426
4,909,510 A * 3/1990 Sahatjian ..... 473/537
4,952,044 A * 8/1990 Murai ..... 351/41
5,776,214 A * 7/1998 Wood ..... 51/309
6,149,742 A * 11/2000 Carpenter et al. ..... 148/563

(Continued)

FOREIGN PATENT DOCUMENTS

WO WO9729892 * 8/1997

OTHER PUBLICATIONS

"Fabrication of Nitinol Materials and Components" taken from "Proceedings of the International Conference of Shape Memory and Superelastic Technologies, Kunming, China, p. 285-292 (2001)" by Ming H. Wu.*

(Continued)

*Primary Examiner* — John Walters
(74) *Attorney, Agent, or Firm* — J. Michael Neary

(57) ABSTRACT

A Nitinol ice blade includes a blade body having attachment structure by which it is held in a blade holder of an ice travel device, such as an ice skate or ice boat. The processes and products made by the processes. The processes include selecting a Type 60 Nitinol sheet or bar that has been hot-worked at a temperature of above about 900° C. to a reduction of at least 2% in the dimension of said hot-working. Blade blanks are cut from the sheet, and the blade blanks are heated to between 600° C. to about 800° C. and immediately quenched to ambient temperature to produce blanks having a hardness of about 48-53 RC. The running edge of the blade blanks a ground to a desired profile and sharpness. The ground blades may then be heated to an elevated temperature of about 850-1000° C. and immediately quenched to produce a hardness at the edge of above 56 RC.

20 Claims, 6 Drawing Sheets

U.S. PATENT DOCUMENTS

| | | | | |
|---|---|---|---|---|
| 6,266,914 | B1 * | 7/2001 | Johnson et al. | 43/42.13 |
| 6,318,738 | B1 * | 11/2001 | Abkowitz et al. | 280/11.18 |
| 7,036,828 | B1 | 5/2006 | Loveridge | |

OTHER PUBLICATIONS

"Fabrication of Nitinol Materials and Components" taken from "Proceedings of the International Conference of Shape Memory and Superelastic Technologies, Kunming, China, p. 285-292 (2001)" by Ming H. Wu.*

Whittom, F.: Desmeules Roy, O.: Bouchard, F.: Comtois, A.S.; "Ice Hockey Players Skating Speed Improved By A Novel Material Skate Blade" Medicine & Science In Sports & Exercise: May 2009 vol. 41, Issue 5, p. 127.

* cited by examiner

NITINOL ICE BLADES

This is related U.S. Provisional Application No. 60/358,988 filed on Feb. 21, 2002 and entitled "Nitinol Ice Blades" and to U.S. Provisional Application Nos. 60/210,902 and 60/265,562 filed on Jun. 11, 2000 and Jan. 31, 2001, respectively, and U.S. patent application Ser. No. 09/879,371 filed on Jun. 11, 2001, which issued as U.S. Pat. No. 6,422,010 on Jul. 23, 2002, entitled "Manufacturing of Nitinol Parts and Forms", and U.S. Provisional Application 60/036,784, 60/029,251, 60/011,648 filed on Jan. 28, 1997, Oct. 24, 1996, and Feb. 14, 1996, respectively, perfected as PCT/US97/02324 on Feb. 14, 1997 and U.S. patent application Ser. No. 09/125,218, issued as U.S. Pat. No. 6,293,020 on Sep. 25, 2001, and Divisional application Ser. No. 09/926,978 filed on Sep. 24, 2001.

This invention relates to Nitinol ice skate blades that have superior erosion resistance, toughness, low sliding friction on ice, and excellent corrosion resistance, and to processes for produce them.

BACKGROUND OF THE INVENTION

Ice skating is a widely popular sport in many countries. The evolution of skating has led to many innovative changes in the hardware used in this sport. These innovations include improved designs for skate blades and the metals used for the blades. Existing ice skate blades are presently manufactured from high carbon steels, stainless steels or titanium. Each of these materials has characteristics that are undesired. Corrosion resistance is an important characteristic for ice skate blades. As a blade corrodes, the cutting edge deteriorates, thus becoming dull. When skate cutting edges are dull, they do not effectively cut into the ice. Sharp cutting edges are important, especially when a skater is making turns. Presently, it is not uncommon for hockey players to grind their skates twice during a competition game. All skating rinks have grinding equipment to provide for the regrinding of blades. Improvements in the ability of ice skate blades to retain a sharp edge and resist corrosion would be an important factor in the sports of hockey, speed skating and figure skating.

High carbon steels are subject to corrosion and thus dulling of the running surface of the blade. Stainless steels have better corrosion resistance properties than the high carbon steel blades however, are still subject to corrosion. Corrosion is the primary reason for the dulling of steel ice skate blades. Thus, if a blade had good corrosion resistance, the time between re-grinding could be reduced.

Ice skate blades produced from high carbon steel are normally plated with chrome or other corrosion resistant materials. This plating however, cannot be applied to the running surface of the blade as they are constantly being re-ground to produce two ice cutting edges. Stainless steel blades have better corrosion resistance than high carbon steel, but in order to be heat treatable to high hardness, substantial carbon content in the alloy is required. This high carbon content increases the potential for corrosion.

Titanium skate blades do have good corrosion resistance properties. However, titanium cannot be processed to have high hardness. Titanium can be processed to have a maximum hardness of ~38 Rockwell C.

An important consideration when selecting a skate blade material, besides hardness of the metal surface that rides on the ice, is brittleness. The skate blade material must be hard enough to minimize erosion of the blade, but not so hard as to be brittle. Hockey blades, especially, must be malleable enough to absorb impacts without shattering.

A third factor, not commonly considered for conventional skate blade design, is the coefficient of friction of the blade on the ice. Skate blades concentrate the weight of the skater in a small area and the resulting pressure produces a film of water, which lubricates the skate blade as it slides over the ice surface. However, there is solid ice contact on skate blade edges during skating, particularly during turning and hard edging while accelerating forward. Improvements to the coefficient of friction of the skate blade on the ice would improve the speed and smooth feel of the skates and would be an improvement much welcomed by skaters.

The same characteristics would also be useful for other ice sliding equipment such as sleds and ice boats, and on other sporting vehicles intended for use on ice, such a luge, bobsled and skeleton.

SUMMARY OF THE INVENTION

Accordingly, this invention provides a Nitinol ice blade and processes for manufacturing a Nitinol ice blade that provides capabilities unavailable in current blades or any known-variant of current blades. In particular, I contemplate the use of Nitinol as hockey, figure and speed ice skating blades. Although both the Type 55 and Type 60 Nitinol material can be used for blade fabrication, the preferred material is the Type 60. Type 60 can be processed to have high hardness (up to Rockwell 62C), has excellent toughness properties, a weight approximately 16% less than steel, superior corrosion resistance, and can be polished to have mirror finishes.

The Nitinol skate blades of this invention run faster on the ice, turn better, and last longer between sharpenings than any skate blade ever known to man. Moreover, they are lighter and chatter less on the ice than current state-of-the-art skate blades. These Nitinol skate blades are corrosion resistant so they will not rust like steel blades between uses, and they have a lower Young's modulus and a higher damping capacity than steel, so they tend to hold their grip on the ice better than steel blades. They have a lower coefficient of friction on the ice than steel and they can be heat treated to have a very smooth and hard oxide finish on the side edges that is even harder and smoother, and has a lower coefficient of friction to produce exceptional running properties on the ice. Type 60 Nitinol can be processed to have a hardness of up to 62 Rockwell C, superior erosion resistance, toughness, and is virtually corrosion proof in the environment of a skating rink. Type 60 Nitinol blades can run on ice approximately five times longer than existing steel blades before re-grinding is required.

The invention includes processes for manufacturing Type 60 Nitinol skate blades. They are cut by available economical cutting processes such as laser or abrasive water jet from rolled Type 60 Nitinol sheet or extruded Type 60 Nitinol bars, and are heat treated to reduce brittleness and improve toughness and impact strength, and give the skate blade an elastic property which I call "ultraelasticity".

The part may be machined to reduce it to near net size, and may be ground to reduce the part to the exact specified part size. For example, flat stock can be surface ground. For parts requiring a smooth surface finish, polishing or lapping provides the specified surface finish on the part, down to 0.5 microinch RMS or finer. The part may be heat treated to obtain the desired hardness, from RC40 to RC65.

An integral surface oxide of any of several colors can be formed on the surface of the part. The oxide surface may itself be polished to an even finer surface finish. These process elements may all be used to produce a particular part that requires the characteristics provided by each process element, and they may be used in combinations that omit particular process elements or substitute others to give the desired characteristics of the part.

The unique physical characteristics of Type 60 Nitinol make it the ideal material to be used for ice blades, and ice skate blades, in particular. The corrosion resistance of the material ensures that blades made from Nitinol will never rust when used on ice. Corrosion of existing steel and stainless steel is a major cost factor to the ice sport industry. Presently, the manufacturers of high carbon steel blades apply chrome plating to the blades in an attempt to reduce the effect of corrosion. The problem this approach is that the runner (bottom) of the blades are periodically ground to resharpen the edges, which of course removes the chrome plating. After exposure to the ice (water) the bottom of the blade corrodes, and thus dulls rapidly. This corrosion process also occurs on stainless steel blades, although it takes longer. Salt for corrosion tests performed on high-carbon steel showed signs of corrosion in salt water within eight minutes, and four hours on 440C type stainless steel. The same tests performed on Type 60 Nitinol showed no corrosion after several thousand hours of exposure to salt fog.

DESCRIPTION OF THE DRAWINGS

The invention and its many attendant benefits and advantages will become better understood upon reading the following detailed description of the preferred embodiments in conjunction with the following drawings, wherein.

DETAILED DESCRIPTION OF THE PREFERRED EMBODIMENTS

Figure 1:
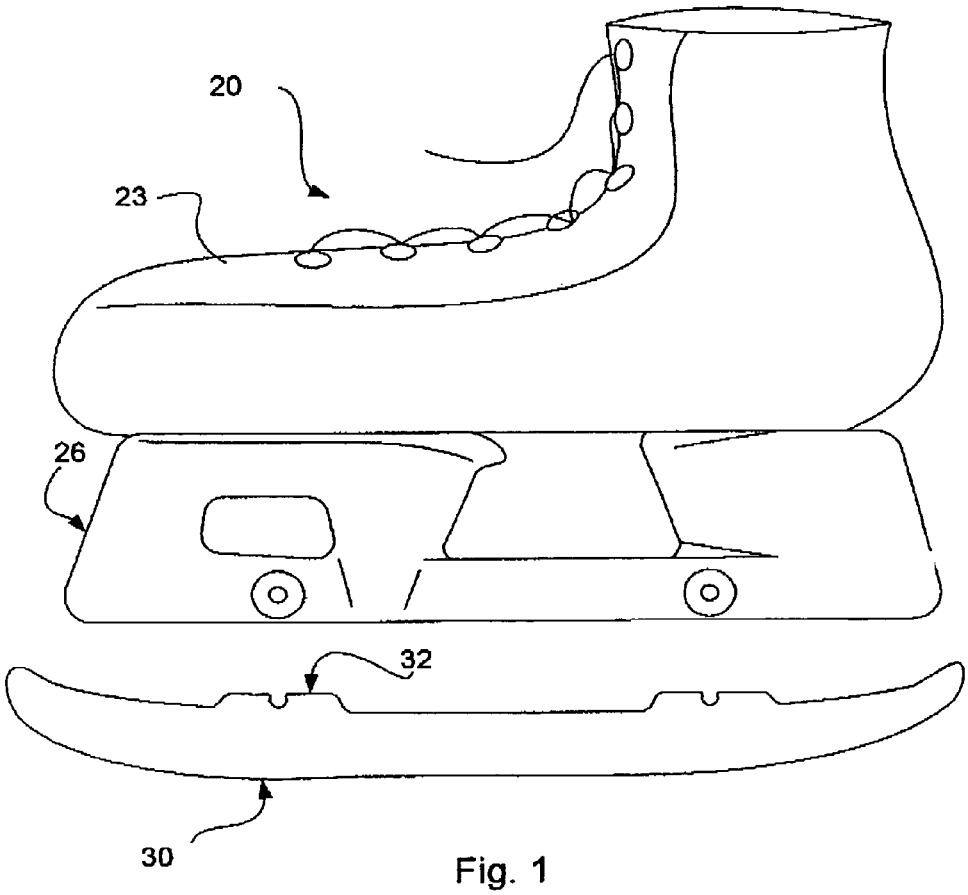
FIG. 1 is an exploded elevation of a hockey ice skate having a Nitinol skate blade in accordance with this invention.
Figure 2:
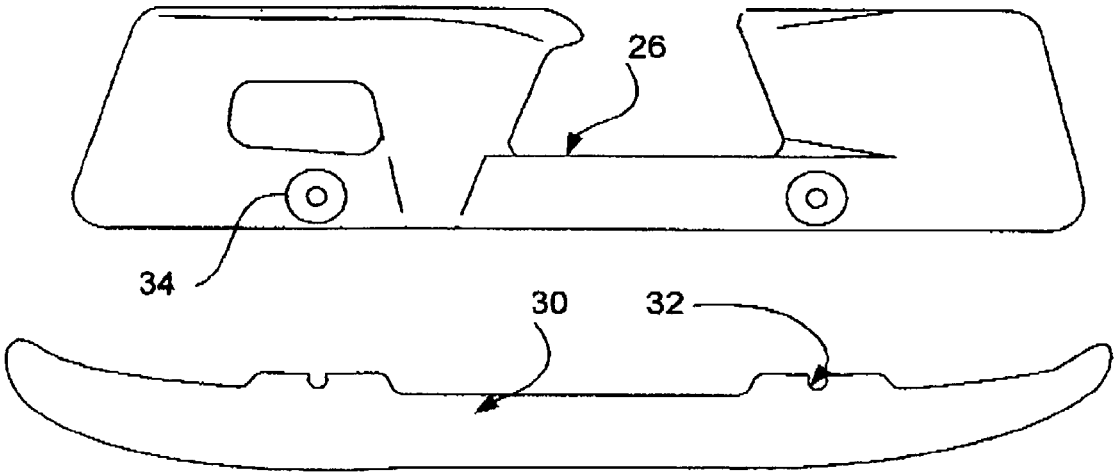
FIG. 2 is an exploded elevation of a hockey ice skate blade holder and skate blade exploded out of the holder.
Figure 3:
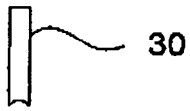
FIG. 3 is an end view of the skate blade shown in FIG. 2.
Figure 4:
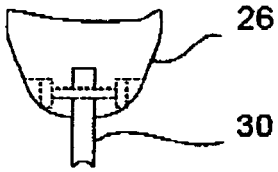
FIG. 4 is an end elevation of the skate blade mounted in the holder shown in FIG. 2.

Referring now to the drawings, wherein like reference numerals designate the same or corresponding parts, and more particularly to FIGS. 1 and 2 thereof, a hockey skate 20 is shown having a boot 23 and a blade holder 26 in which a skate blade 30 in accordance with this invention is removably mounted. The skate blade 30 has attachment structures 32 for engaging complementary structures 34 on the blade holder 26 to securely attach the skate blade 30 to the blade holder 26. These structures 32 and 34 are conventional and are well known to those skilled in the art.

Figure 5:
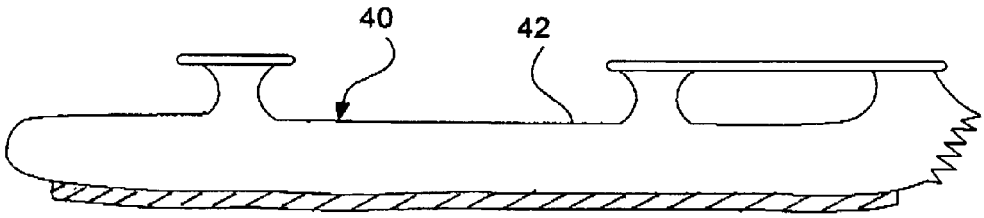
FIG. 5 is a is an elevation of a figure skate having a Nitinol skate blade in accordance with this invention.
Figure 6:
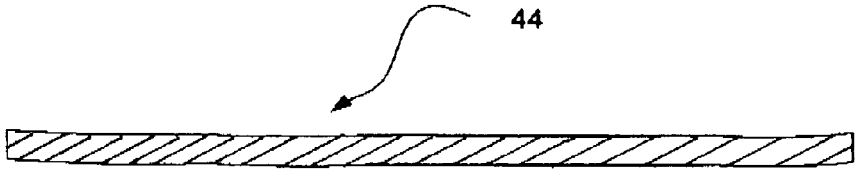
FIG. 6 is a sectional elevation of the Nitinol skate blade shown in FIG. 5.
Figure 7:
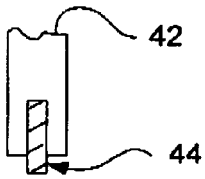
FIG. 7 is an end sectional elevation of one version of the skate blade shown in FIG. 5.
Figure 8:
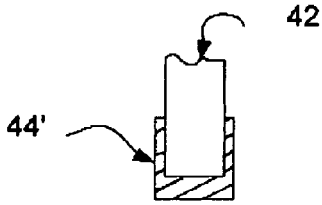
FIG. 8 is an end sectional elevation of another embodiment of the skate blade shown in FIG. 5.
Figure 9:
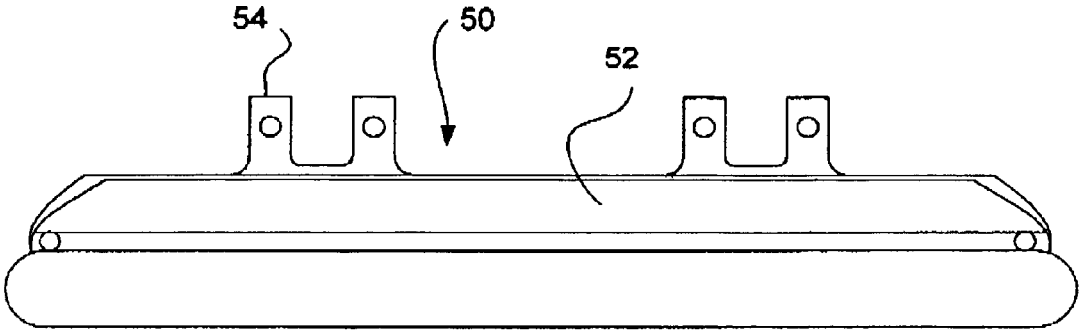
FIG. 9 is an elevation of a speed skate blade in accordance with this invention.

A figure skate blade 40, shown in FIG. 5, has a Nitinol edge 44 attached to a Titanium or stainless steel blade body 42 by welding, such as laser welding. The edge 44 can also be fitted into a groove in the blade body 42 as shown in FIG. 7, or can be fitted around the blade body in a channel shaped edge 44' as shown in FIG. 8.

Figure 10:
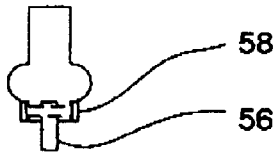
FIG. 10 is a sectional elevation of the skate blade shown in FIG. 9.

A speed skate blade 50, shown in FIG. 10, has a skate body 52 with conventional attachment structure for attaching the blade 50 to a speed skate boot. It could alternatively have the now conventional clap skating structure that attaches the blade to the skate boot with a pivotal attachment. A Nitinol edge structure 56 fits into a groove in the skate blade 50 is attached to the blade 50 by attachment structure 58.

As used herein, the term ice blade and ice skate blade is intended to encompass other types of apparatus and equipment that slide on ice, such as sleds and ice boats, and sporting vehicles intended for use on ice, such a luge, bobsled and skeleton.

Nitinol is a nickel-titanium intermetallic compound invented at the Naval Ordinance Laboratory in the early 1960's. It is a material with useful properties, but manufacturers who have worked with it have had little success in making Nitinol parts and semi-finished forms. Because Nitinol is so extremely difficult to form and machine, workers in the metal products arts usually abandoned the effort to make products out of anything except Type 55 Nitinol drawn wire because the time and costs involved did not warrant the paltry results they were able to obtain.

Type 60 Nitinol (60% Nickel and 40% Titanium by weight), has many properties that are unrecognized as of potential value. It can be polished to an extremely smooth finish, less than 1 microinch rms. It is naturally hard and can be heat treated to a hardness on the order of 62 Rc or higher. It can be processed to have a very hard integral complex oxide surface that can itself be polished to an even smoother surface than the parent metal. It is non-magnetic, immune to corrosion from most common corrosive agents, and can be treated to have a high yield strength and toughness, even at elevated temperatures. It is 26% lower density than steel for weight sensitive applications such as aircraft, satellites and spacecraft. However, there has hitherto been little effort in making useful parts out of Type 60 Nitinol because it is so difficult to work, because it was known to be brittle, and because there has been no known method to make parts and forms out of it.

Type 60 Nitinol can be hot rolled from a cast billet by successive hot passes through a rolling mill. It can be successfully rolled at a temperature of about 900° C. to 950° C. to a reduction of at least about 2% per pass in the dimension of the hot-working. The polled sheet is normally hard and brittle without subsequent heat treatment.

Figure 11:
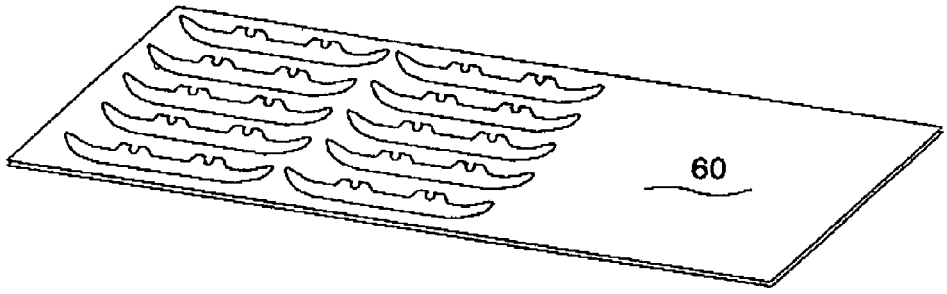
FIG. 11 is a perspective view of a sheet of 60 Nitinol with blade blanks shown.
Figure 12:
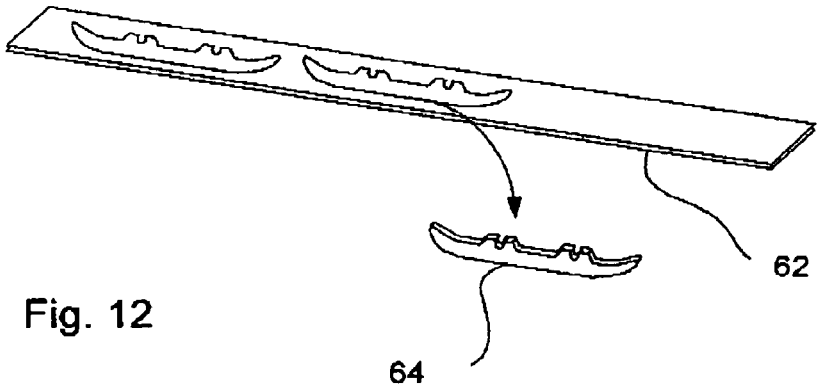
FIG. 12 is a perspective view of an extruded bar of 60 Nitinol with a blade blank shown.
Figure 13:
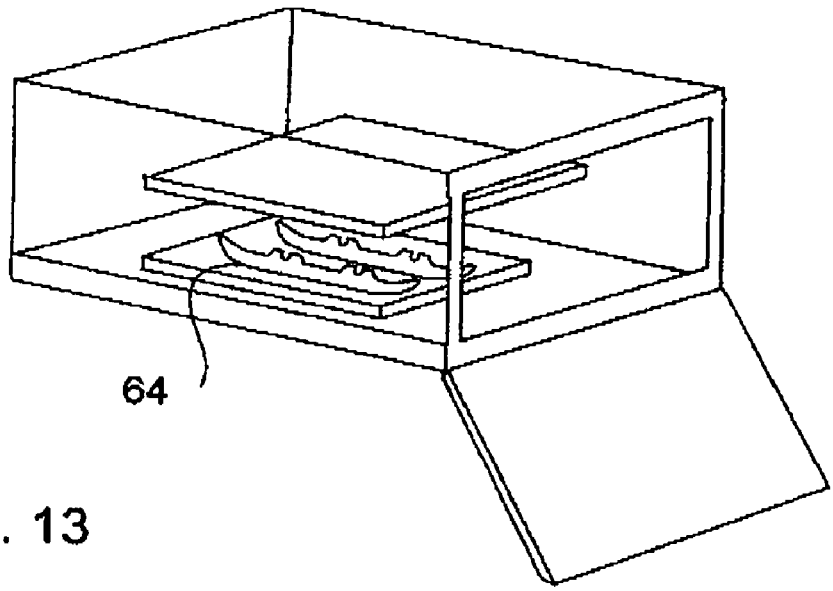
FIG. 13 is a perspective view of a furnace for treatment of blade blanks, and, FIG. 14 is a perspective view of a water bath.
Figure 14:
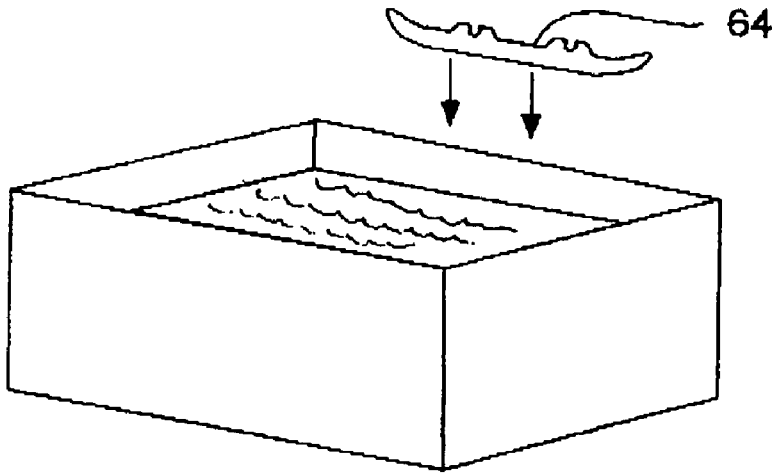

To make ice blades, as illustrated in FIGS. 11 and 12, a Type 60 Nitinol sheet or plate 60 that has been hot-worked as noted above, or an extruded bar 62 shown in FIG. 12, is selected and blade blanks 64 are cut out of the sheet. They are cut by available economical cutting processes such as laser or abrasive water jet from rolled Type 60 Nitinol sheet 60 or extruded Type 60 Nitinol bars 62, and are heat treated, as described below, to reduce brittleness and improve toughness and impact strength, and give the skate blade an elastic property which I call "ultraelasticity".

Nitinol ice skate blades must be processed to be both tough and hard. The hardness and toughness of the blades is achieved in accordance with this invention by a heat treatment process. The optimum hardness of the blade strong back is 48 to 53 Rockwell C. The hardness of the bottom of the runners can be processed to have a higher hardness (up to 62 Rc) if desired.

The high toughness properties of Type 60 Nitinol can be achieved by heating the blade blanks in an oven to between 600° C. and 800° C., preferably about 700° C.±20° C., and then rapidly quenching the blank in a coolant such as oil or water. This yields the desired characteristics of high hardness and toughness for the blade blanks. The optimum hardness for the blades is 49 to 53 Rockwell C and a yield strength of over 120,000 psi.

The surface of the blade that contacts the ice can be heat treated to have high hardness, up to 62 Rockwell C. The process consists of heat sinking the strong back of the knife and heating only the contact surface to approximately 900 to 1000 degrees C.°, for example, with an acetylene torch, induction coil, or other localized heating process, and then rapidly quenching the blade in water or oil.

The blade blanks 64 are finish ground to the desired final dimensions to fit properly in the blade holders 26. Prior to grinding the skate blade blanks 64 to the desired thickness, they should be flattened. Type 60 Nitinol parts may be shaped to a desired contour without spring-back by a process involving forming the part to the desired contour and heat treating it while holding it at the desired contour. One technique for performing this process is to heat the blade blanks in a furnace or oven at a temperature of 600° C.-800° C., preferably 700 C.°. The skate blade blanks are laid onto a thick steel plate, having a flat top surface, in the furnace, and another thick steel plate, having a flat bottom surface, is placed on top of the blade blanks. The assembly is inserted in a preheated oven and, after temperature equalization, the parts are held at the 700° C. temperature for a minimum of fifteen minutes. The blade blanks are then removed and immediately quenched in a water bath. The blade blanks should be held vertical when quenched in the water to minimize warping of the blade from uneven cooling. It is also desirable that the time between removal of the blade from the furnace and quenching be as short as possible. The time lag between furnace removal and quenching should be within about twenty seconds, preferably within 15 seconds from removal from the oven. In order to minimize the time lag between removal of the blanks from the oven and the quenching operation, it is convenient to locate the quenching tank close to the oven. This short lag time is useful to maintain the temperature of the blade close to 700° C. at the start of the quench process. This process aligns the crystals within the material and produces a flat tough Nitinol ice blade. The hardness of the blade at this point in the manufacturing process is about 48 to 51 Rockwell C.

The flat blade blank is now ready to be ground to the required thickness. The preferred method to grind the blades is to run them through a "timesaver machine", which is a large belt grinder. To obtain a good finish on each side of the blade they should be ground on both sides. The preferred grinding belts to be used are those made from a grinding media called Cubatron, a 3M company product. Cubatron belts of 60 grit are preferred, although other grid sizes can be used. A light pressure and shallow grinding passes are preferred because they produce little heat increase and do not cause significant rounding of the corners. When the blades are at the required thickness, final polishing may be accomplished using another 3M timesaver belt called Trizak. Other types of grinding media can also be used obtain the required blade thickness, however the above described grinding media is preferred.

Upon completion of the above grinding operations the blades are ready for final processing. The final processes insure that all metallurgical changes produced by the cold work that was applied by the timesaver grinding operations is removed, applies the black oxide finish onto the surface of the blades, and insures toughness in the blades.

This final process is identical to the heat treatment used to flatten the blade. All residue from the grinding operations is removed prior to the blades being installed in the oven. The oven is preheated to the 700° C., the blades installed between the two steel plates with flat facing surfaces, and the temperature held for approximately fifteen minutes after equalizing. The blades are then removed and quenched as described above.

A hard and slippery black oxide finish is produced with this process. The oxide finish may then be polished to an extremely smooth finish using a buffing wheel with diamond paste or jewelers rouge.

The oxide finish produced during the above-described processes is hard and non-electrically conductive, which prevents conventional electro chemical etching processes to be used to apply engraving on the blades. Logos, part numbers, or designs on the blades may be applied after formation of the oxide surface material by laser engraving, or may be applied after polishing and before oxide formation by electro-chemical engraving.

Type 60 Nitinol skate blades rarely, if ever, need sharpening. The ice-contact edge is so hard and abrasion resistant, that there is very little abrasive wear of the edge material. Moreover, the material is essentially corrosion-proof, so there is no significant corrosion of the ice-contacting edges, which is the primary cause of edge dulling in conventional skate blades. However, grinding of the running surfaces of the skate blades is necessary during manufacturing and may occasionally be desirable after an extended period of hard use. On some blades a hollow grind is used, for example hockey skate blades. On other types of blades a flat or wedge grind is preferred. Grinding and final forming of the blades may be performed on a conventional skate blade sharpening machine such as a "Blademaster" three station skate sharpening machine made by Guspro Inc. in Chatham, Ontario, Canada. Conventional skate blade grinding equipment, such as the Blademaster, uses silicon carbide blades and diamond hones for the final pass. For Nitinol skate blades in accordance with this invention, the process is similar but differs in significant aspects, noted below. Conventional blade grinding wheels may be used to grind the Type 60 Nitinol skate blades, but the process is lengthy and the conventional grinding wheels wear down quickly. Cubitron grinding wheels, newly available from Cincinnati Milicron Company in Cincinnati, Ohio, are preferred. To minimize excessive heating of the skate blade bottom edge during grinding, it is preferable to grind in rapid shallow passes of about 0.002"-0.003". A diamond hone may be used as a final pass to produce a very smooth finish and especially sharp edges. The diamond hone may also be used to sharpen the blade edges after extended use, but should be applied with light pressure to avoid pulling the diamond particles out of the hone.

Permanent marking of the blades, part numbers, logos, serial numbers etc, can be accomplished using electrochemical etching or laser engraving processes. If chemical etching is to be used, the markings should be applied prior to the application of the oxide film because the oxide is an effective electrical current isolator and interferes with the electrochemical etching process. Laser etching processes however, work well on both the uncoated and coated material.

The ultraelastic Type 60 Nitinol workpiece may be heat treated to a desired combination of hardness and elasticity. For example a hardness of about 58 RC-64 RC may be obtained by heating it to about 900° C.-950° C. and then quenching in water or other coolant such as oil to cool it quickly to a temperature below about 500° C. The coolant should be agitated or the part moved in the coolant bath to ensure a flow of coolant over the surface of the part to ensure even cooling and prevent development of an insulating steam cushion over portions of the part. The hardness can be tailored by the temperature of the initial heating. Rapid quenching produces a surface hardness of about 58-64 RC at some sacrifice to the elasticity of the material. The strength of the ultraelastic Type 60 Nitinol heat treated to about 50-55 Rockwell C and a strength of about 140,00-155,000 psi and has an elastic strain capability of about 3% up to about 6%.

To retain the ultraelastic properties in a portion of the workpiece but high hardness in other portions such as the edge of a ice skate blade, the portion that need not be hardened can be clamped in a heat sink and the other portion, such as the ice-contacting edge, is heated to a hardening temperature of 900° C.-950° C. and then rapidly quenched in water or other coolant. The heat sink prevents the unhardened portion from being heated to the hardening temperature so it retains its ultraelastic properties.

Tests performed on 60 Nitinol Hockey blades showed substantially improved results. Hockey skaters stated the blades provided improved turning and much higher speeds on the ice. The testers also used the blades for extended periods of time without the need for frequent re-sharpening.

Obviously, numerous modifications and variations of the preferred embodiment described above are possible and will become apparent to those skilled in the art in light of this specification. For example, the ice skating blade in accordance with this invention could be used for improved speed and control on sleds and ice boats, and on other sporting vehicles intended for use on ice, such a luge, bobsled and skeleton. Moreover, many functions and advantages are described for the preferred embodiment, but in many uses of the invention, not all of these functions and advantages would be needed. Therefore, I contemplate the use of the invention using fewer than the complete set of noted features, process steps, benefits, functions and advantages. For example, all the process elements may be used to produce a particular part that requires the characteristics provided by each process element, or alternatively, they may be used in combinations that omit particular process elements or substitute others to give the desired characteristics of the part. Moreover, several species and embodiments of the invention are disclosed herein, but not all are specifically claimed, although all are covered by generic claims. Nevertheless, it is my intention that each and every one of these species and embodiments, and the equivalents thereof, be encompassed and protected within the scope of the following claims, and no dedication to the public is intended by virtue of the lack of claims specific to any individual species. Accordingly, it is expressly intended that all these embodiments, species, modifications and variations, and the equivalents thereof, in all their combinations, are to be considered within the spirit and scope of the invention as defined in the following claims, Wherein I claim:

1. An ice skate blade, comprising:

an elongated blade body having a main blade portion and an edge portion made from Type 60 Nitinol;

said edge portion of said blade body having an ice-contacting bottom edge;

said main blade portion having structure for engaging a blade holder;

said bottom edge having opposed corners that are sharpened to bite into ice to facilitate travel and maneuvering on said ice;

said main blade portion having an impact strength of greater than 45 foot-pounds and a hardness greater than about 40 RC.

2. An ice blade as defined in claim 1, wherein:

said main blade portion has a tensile strength of greater than 130 KSI and an elastic elongation of more than 3%.

3. An ice blade as defined in claim 1, wherein:

said blade body has a hardness between about 48 RC and 55 RC.

4. An ice blade as defined in claim 1, wherein:

said ice blade is an ice skate blade, and said blade holder is affixed to an ice skate boot;

said structure for engaging a blade holder includes structure on a top edge, opposite to said bottom edge, for engaging said blade holder of said ice skate boot.

5. An ice skate blade as defined in claim 1, wherein:

said elongated blade body edge portion is free of reinforcement by any hardening constituent other than derivatives of Type 60 Nitinol.

6. A method of making ice blades, comprising:

selecting a Type 60 Nitinol sheet that has been hot-worked at a temperature of about 900° C. to 950° C. to a reduction of at least about 2% in the dimension of said hot-working;

cutting ice blade blanks from said sheet;

heating said blanks to between 600° C. to about 800° C. and immediately quenching said blanks to ambient temperature to produce blanks having a hardness of about 48-53 RC; and grinding one edge of said blade blanks to a desired profile and sharpness.

7. A method as defined in claim 6, further comprising:

heat treating of the bottom of the blade to produce a very hard and erosion resistant surface.

8. A method as defined in claim 7, wherein:

said heat treating of said bottom of said blade includes heating said one edge to an elevated temperature of about 850-1000° C. and immediately quenching said blade blank to produce a hardness at said one edge of above 56 RC.

9. A method as defined in claim 6, wherein:

said grinding step includes rotating a narrow grinding blade, made primarily of cubic boron nitride, against said one end of said blade blanks and grinding off a layer of Nitinol in several passes, each pass being at a depth of 0.015"-0.020".

10. The method as defined in claim 9, further comprising:

immediately after said holding period, rapidly quenching said part in coolant from said temperature to a temperature below about 400° C.

11. A method as defined in claim 8, further comprising:

heating said part to a temperature above 700° C.;

placing said part between matched dies having a die interface profile corresponding to said desired shape; and holding said part at said temperature for a period of at least about 15 minutes.

12. The method as defined in claim 10, wherein:

said part is an ice blade and said desired shape is flat.

13. An ice skate, comprising:

an elongated blade body having a main blade portion and an edge portion made from Type 60 Nitinol;

said edge portion of said blade body having an ice-contacting bottom edge;

said main blade portion having structure engaged in a blade holder that is fastened to a boot;

said bottom edge having opposed corners that are sharpened to bite into ice to facilitate travel and maneuvering on said ice;

said main blade portion having an impact strength of greater than 45 foot-pounds and a hardness greater than about 40 RC.

14. An ice skate as defined in claim 13, wherein:

said main blade portion has a tensile strength of greater than 130 KSI and an elastic elongation of more than 3%.

15. An ice blade as defined in claim 13, wherein:

said blade body has a hardness between about 48 RC and 55 RC.

16. An ice skate as defined in claim 13, wherein:

said main blade portion has a Young's modulus that is lower than the Young's modulus of steel.

17. An ice skate as defined in claim 13, wherein:

said main blade portion has a higher damping capacity than steel.

18. An ice skate as defined in claim 13, wherein:

said main blade portion has a lower coefficient of friction on the ice than steel.

19. An ice skate as defined in claim 13, wherein:

said edge portion of said blade body heat treated to have a smooth and hard oxide finish on bottom and side edges thereof that is harder and smoother than said main blade portion, and has a lower coefficient of friction to produce glide and running properties on ice superior to steel.

20. An ice skate as defined in claim 13, wherein:

said blade body is heat treated to reduce brittleness and improve toughness and impact strength, and give the skate blade an elastic property called ultraelasticity.

* * * * *